US005365703A

United States Patent [19]

Zeidler

[11] Patent Number: 5,365,703

[45] Date of Patent: Nov. 22, 1994

[54] TAR HOLDER AND ASSOCIATED ROOFING MATERIALS

[76] Inventor: Bernard Zeidler, 150-15 72 Rd. Studio A, Flushing, N.Y. 11267

[21] Appl. No.: 229,426

[22] Filed: Apr. 12, 1994

Related U.S. Application Data

[62] Division of Ser. No. 926,196, Aug. 7, 1992, abandoned.

[51] Int. Cl.[5] ..... E04D 1/36

[52] U.S. Cl. ..... 52/62; 52/218; 52/219

[58] Field of Search ..... 52/58, 62, 198, 218, 52/219, 408, 61

[56] References Cited

U.S. PATENT DOCUMENTS

| | | | |
|---|---|---|---|
| 3,277,618 | 10/1966 | Smith | 52/58 |
| 3,447,273 | 6/1969 | Thom | 52/58 |
| 3,763,605 | 10/1973 | Freeman | 52/58 |
| 4,223,486 | 9/1980 | Kelly | 51/1 |
| 4,524,262 | 6/1985 | Meyer | 52/219 X |
| 4,841,687 | 6/1989 | Navetta | 52/58 |
| 4,888,930 | 12/1989 | Kelly | 52/62 X |

FOREIGN PATENT DOCUMENTS

| | | | |
|---|---|---|---|
| 1026076 | 2/1978 | Canada | 52/58 |
| 2363016 | 7/1975 | Germany | 52/58 |
| 2904701 | 8/1980 | Germany | 52/219 |
| 8302479 | 9/1984 | Netherlands | 52/198 |

*Primary Examiner*—Lanna Mai
*Attorney, Agent, or Firm*—Judith Adele Plotkin

[57] ABSTRACT

A water, fire and heat proof roof is provided and consists of a tar holder affixed about an inner surface of a parapet, so that a lower portion of the tar holder will overlap and cover curved ends of an upper layer of polymer roof covering material to help keep the roof water proof, heat proof, fire proof and cool. A water sprinkler system is also utilized to prevent a fire and reduce heat on the roof to keep it cool.

12 Claims, 2 Drawing Sheets

TAR HOLDER AND ASSOCIATED ROOFING MATERIALS

This is a division of U.S. application Ser. No. 07/926,196, filed on Aug. 7, 1992, abandoned.

BACKGROUND OF THE INVENTION

The instant invention relates generally to roofing materials and more specifically it relates to water, fire and heat proof roof, which provides a structure applied to a roof, so that the roof will remain cool.

There are available various conventional roofing materials which do not provide the novel improvements of the invention herein disclosed.

SUMMARY OF THE INVENTION

A primary object of the present invention is to provide a water, fire and heat proof roof that will overcome the shortcomings of the prior art devices.

Another object is to provide water, fire and heat proof roof, in which a tar holder is applied about a roof to form a better seal between the flashing and the roof covering materials to help keep the roof cool.

An additional object is to provide a fire and heat proof roof in which a sprinkler watering system is placed upon the roof to prevent fires and keep the roof cool during hot weather conditions.

A further object is to provide a fire and heat proof roof that is simple and easy to use.

A still further object is to provide a fire and heat proof roof that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
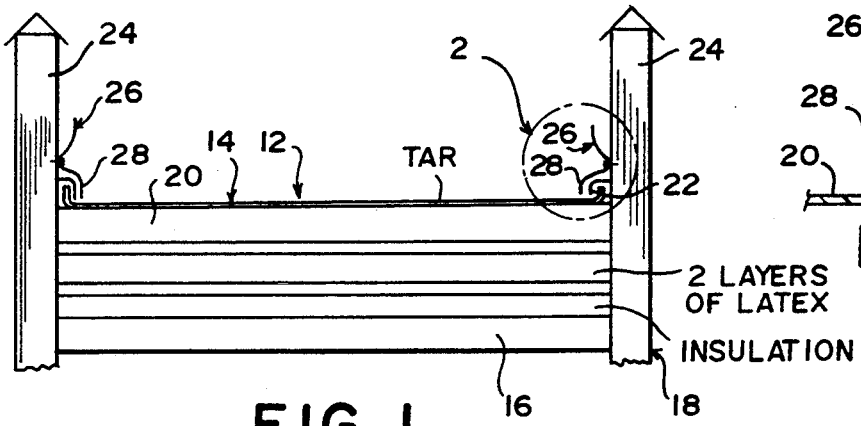
FIG. 1 is a diagrammatic cross section of a roof with the instant invention installed thereon.
Figure 2:
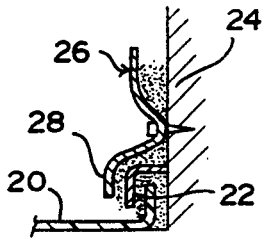
FIG. 2 is an enlarged detail view as indicated by arrow 2 in FIG. 1, showing the tar holder.

Turning now descriptively to the drawings, in which similar reference characters denote similar elements throughout the several views, the Figures illustrate a water and heat proof roof 12, which consists of a plurality of layered waterproof roof covering material 14 applied onto a roof 16 of a building 18, with the ends of an upper layer of the roof covering materials 14, being a sprayed laminated polymer sheet 20 that curves up behind the overlapping flashing 22, that is secured about an inner surface of a parapet 24 on the roof 16. A tar holder 26 is affixed about the inner surface of the parapet 24, so that a lower portion 28 of the tar holder 26 will overlap and cover the curved ends of the upper layer polyester sheet 20 of the roof covering materials 14 to form a better tar seal between the flashing 22 and the roof covering materials 14 to help keep the roof 16 cool and water proof.

Figure 3:
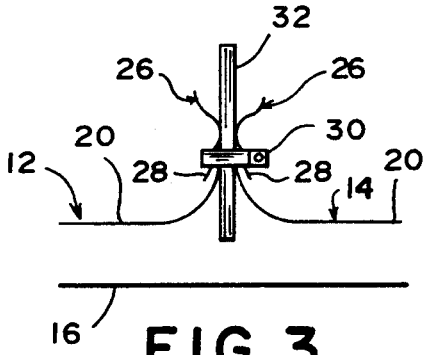
FIG. 3 is a diagrammatic cross sectional view showing the tar holder applied to an air vent pipe.

In FIG. 3, a pipe clamp 30 is provided to secure the lower portion 28 of the tar holder 26 about an air vent pipe 32 on the roof of the building 18.

Figure 4:
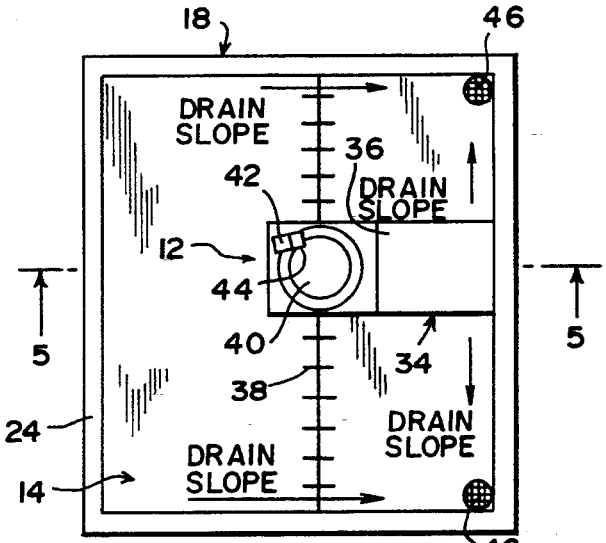
FIG. 4 is a diagrammatic top view of a roof with a water, fire and heat proof sprinkling system.
Figure 5:
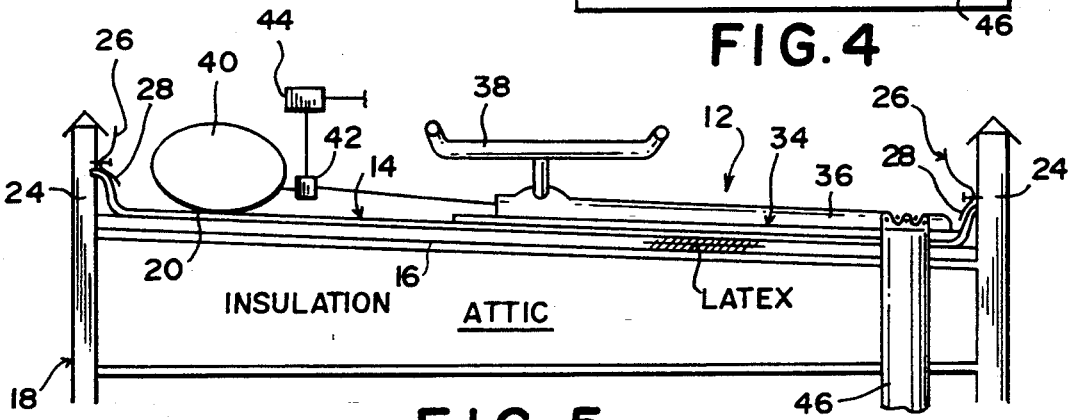
FIG. 5 is a diagrammatic cross sectional view taken along line 5—5 in FIG. 4, showing, a slightly different layout on the roof.

In FIGS. 4 and 5, at least one flat frame 34 is placed upon the roof covering materials 14. At least one flat sponge sheet 36 is retained in the at least one flat frame 34. At least one sprinkler 38 is positioned upon the at least one flat sponge sheet 36. A tank 40 that holds rain water therein is positioned upon the roof covering materials 14. A pump 42 is fluidly connected between the tank 40 and the at least one sprinkler 38 to supply water to the at least one sprinkler 38. A timer 44 is electrically connected to the pump 42 to operate the pump 42 at a predetermined time interval. The at least one sprinkler 38 will spray the rain water over the at least one flat sponge sheet 36 to prevent a fire and reduce the heat on the roof covering materials 14 to keep the roof 16 cool. A drain 46 is placed within the roof 16 to carry off the excess rain water therefrom.

Figure 7:
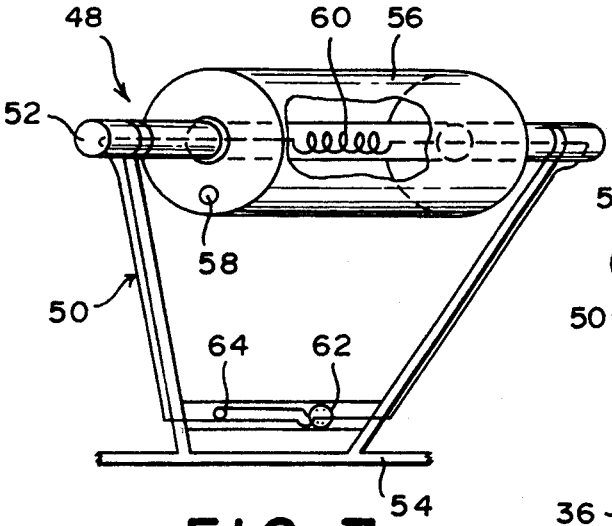
FIG. 7 is a diagrammatic perspective view of a hot oil heater roller.
Figure 8:
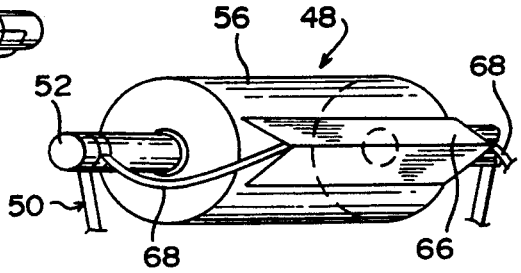
FIG. 8 is a diagramatic perspective view of just the tank assembly showing a two blade scraper applied to the cylinder tank to keep it clean.
Figure 6:
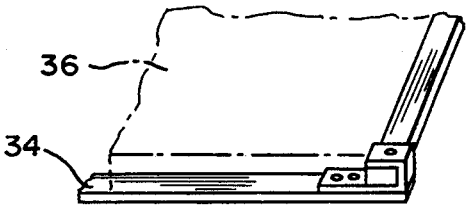
FIG. 6 is a perspective view of a portion of the sponge frame.

A hot oil heater roller 48, shown in FIGS. 7 and 8, is provided and consists of a housing 50 having an axle 52 and a handle 54. A rotatable cylindrical tank 56 is on the axle 52. The tank 56 has a fill opening 58 for the oil. A heater coil 60 is within the axle 52, a thermostat 62 near the handle 54 is electrically connected to the heater coil 60 and a control kbob 64 near the handle 54 is electrically connected to the thermostate 62 and the heater coil 60. A person can grip the handle 54 to roll the heated cylindrical tank 56 over the said upper sheet 20 of the roof covering materials 14, to compress and dry the fiber particles into the upper layer 20. A two bladed scraper 66 is spring biased at 68 on the axle 52 of the housing 50 to clean the heated cylindrical tank 56, when rolled over the upper layer 20 of the roof covering materials 14.

Figure 9:
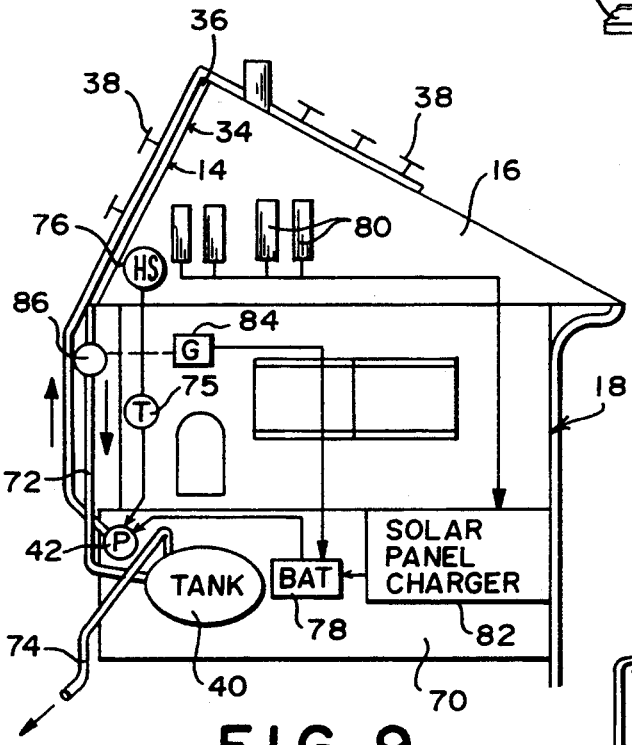
FIG. 9 is a diagramatic elevational view of a building with a rain water storage tank cooling system in the basement.

The building 18, in FIG. 9, contains at least one flat frame secured to the roof covering materials 14. At least one flat sponge sheet 36 is retained in the at least one flat frame 34. At least one sprinkler 38 is secured upon the at least one flat sponge sheet 36. A tank 40 to hold rain water therein, is placed within a basement 70 of the building 18. A pump 42 is fluidly connected between the tank 40 and the at least one sprinkler 38 to supply water to the at least one sprinkler 38. A conduit 72 is connected between the at least one flat sponge sheet 36 and the tank 40 to bring the access water back into the tank 40. A drain pipe 74 is connected to the tank 40 to remove overflow water out of the tank 40.

A thermostat 75 is electrically connected to the pump 42. A heat sensor 76 is on the roof and is electrically connected to the thermostat 75 to turn on the pump 42 when the temperature rises to a dangerous level. A battery 78 is electrically connected to the pump 42 to supply electricity to operate the pump 42. A plurality of solar panels 80 are on the roof 16. A solar panel charger 82 is electrically connected between the solar panels 80 and the battery 78 to recharge the battery 78. A generator 84 is electrically connected to the battery 78, while a water turbine 86 is within the conduit 72 to operate the generator 84 when water flows through the conduit 72, so that the generator 84 can also recharge the battery 78.

Figure 10:
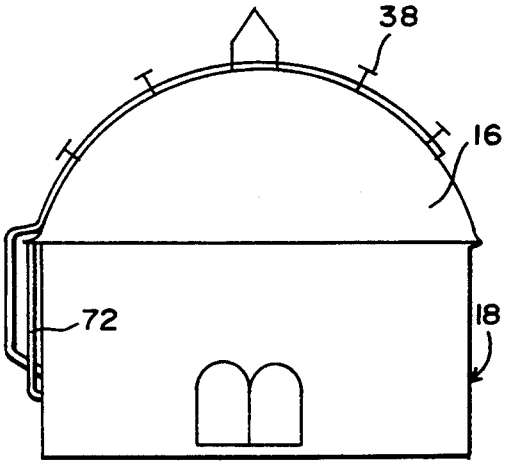
FIG. 10 is a diagramatic elevational view of a dome roof building which can be utilized with the cooling system.

In FIG. 10, a round dome roof 16 on the building 18 can also be utilized for carrying the at least one sprinkler 38 thereon, with the other components shown in FIG. 9 connected thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A water, fire and heat proof roof with flashing mounted on a parapet wall inner surface at right angles to the roof comprising:

a) a plurality of layered waterproof roof covering materials applied onto said roof of a building, having an upper layer with curved ends which extend behind and spaced from said flashing; and b) a tar holder with an upper portion and a lower portion affixed about said inner surface of said parapet wall so that said lower portion of said tar holder is spaced from behind and overlaps said curved ends to form a tar pocket for a better seal between said flashing and said roof covering materials to help keep the roof cool and waterproof.

2. A water, fire and heat proof roof as recited in claim 1, further including a second tar holder a pipe clamp securing the lower portion of said second tar holder about an air vent pipe on the roof of the building.

3. A tar holder, affixed about an upright structure on a roof covered with waterproof roof covering materials having curved ends, comprising:.

a) an upper portion filled with tar;

b) a lower portion which is spaced from and overlaps the curved ends of the waterproof covering materials;

c) a flashing mounted between said structure and said lower portion, having one end attached to said structure and a second end parallel to said upright structure and spaced from said lower portion and said roof covering materials; and d) a means to affix said holder to said structure;

wherein said curved ends extend between and spaced from said flashing and said structure and wherein said lower portion and said curved ends form a tar pocket for a seal between said flashing and said roof covering materials to help keep the roof cool and waterproof.

4. A tar holder as described in claim 3 wherein said structure is a parapet wall.

5. A tar holder as described in claim 3 wherein said structure is a pipe.

6. A tar holder as described in claim 5 wherein said pipe is an air vent pipe.

7. A water, fire and heat proof roof with a flashing mounted on an upright structure comprising:

a) a plurality of layered waterproof roof covering materials applied onto said roof of a building, having at least one layer with curved ends which extend between and spaced from said flashing and said structure; and b) a tar holder comprising an upper portion; a lower portion spaced from and overlapping said curved ends; and said flashing which has one end attached to said structure and a second end parallel to said structure and spaced from said structure, said lower portion, and said roof covering materials.

8. A water, fire and heat proof roof as described in claim 7 wherein said upright structure is a parapet wall.

9. A water, fire and heat proof roof as described in claims 8, further including at least one additional tar holder secured to a pipe on the roof.

10. A water, fire, and heat proof roof as described in claim 9 wherein said pipe is an air vent pipe.

11. A water, fire and heat proof roof as described in claim 7 wherein said upright structure is a pipe.

12. A water, fire and heat proof roof as described in claim 7 wherein said upright structure is an air vent pipe.

* * * * *